US007864491B1

(12) United States Patent
Bauder et al.

(10) Patent No.: US 7,864,491 B1
(45) Date of Patent: Jan. 4, 2011

(54) PILOT SWITCH

(75) Inventors: Ruediger Bauder, Feldkirchen-Westerham (DE); David Durgin Coons, Greensboro, NC (US); David C. Dening, Stokesdale, NC (US); Jon D. Jorgenson, Greensboro, NC (US)

(73) Assignee: RF Micro Devices, Inc., Greensboro, NC (US)

( * ) Notice: Subject to any disclaimer, the term of this patent is extended or adjusted under 35 U.S.C. 154(b) by 571 days.

(21) Appl. No.: 11/846,237

(22) Filed: Aug. 28, 2007

(51) Int. Cl.
*H01H 9/30* (2006.01)
*H01H 73/18* (2006.01)

(52) U.S. Cl. ..... 361/13; 361/2; 361/8

(58) Field of Classification Search ..... 361/13, 361/2, 8
See application file for complete search history.

(56) References Cited

U.S. PATENT DOCUMENTS 4,658,320 A * 4/1987 Hongel ..... 361/13
4,959,746 A * 9/1990 Hongel ..... 361/13
5,483,188 A * 1/1996 Frodsham ..... 327/170
5,834,860 A * 11/1998 Parsons et al. ..... 307/98
6,184,729 B1 * 2/2001 Pasqualini ..... 327/112
6,643,112 B1 * 11/2003 Carton et al. ..... 361/152
6,741,435 B1 * 5/2004 Cleveland ..... 361/2
7,253,709 B1 * 8/2007 Chang et al. ..... 335/78
7,653,985 B1 * 2/2010 Chang et al. ..... 29/622
2007/0188846 A1 * 8/2007 Slicker et al. ..... 359/290

* cited by examiner

*Primary Examiner*—Stephen W Jackson
*Assistant Examiner*—Zeev Kitov
(74) *Attorney, Agent, or Firm*—Withrow & Terranova, P.L.L.C.

(57) ABSTRACT

Pilot switch circuitry coupled across first and second terminals of a microelectromechanical system (MEMS) switch is provided to reduce or eliminate arcing between a cantilever contact and a terminal contact when the MEMS switch is opened or closed. The pilot switch circuitry establishes a common potential at the first and second terminals prior to, and preferably until, the cantilever contact and terminal contact come into contact with one another when the MEMS switch is closed. The pilot switch circuitry may also establish a common potential at the first and second terminals prior to, and preferably after, the cantilever contact and terminal contact separate from one another when the MEMS switch is opened.

21 Claims, 9 Drawing Sheets

PILOT SWITCH

FIELD OF THE INVENTION

The present invention relates to microelectromechanical system (MEMS) switches, and in particular to pilot switch circuitry that reduces or eliminates arcing between MEMS switch contacts when the MEMS switch is opened or closed.

BACKGROUND OF THE INVENTION

As electronics evolve, there is an increased need for miniature switches that are provided on semiconductor substrates along with other semiconductor components to form various types of circuits. These miniature switches often act as relays, generally range in size from a micrometer to a millimeter, and are generally referred to as microelectromechanical system (MEMS) switches.

In some applications, MEMS switches are configured as switches and replace field effect transistors (FETs). Such MEMS switches reduce insertion losses due to added resistance, and reduce parasitic capacitance and inductance inherent in providing FET switches in a signal path. MEMS switches are currently being deployed in many radio frequency (RF) applications, such as antenna switches, load switches, transmit/receive switches, tuning switches, and the like. For instance, transmit/receive systems requiring complex RF switching capabilities may utilize a MEMS switch.

Turning to FIGS. 1A and 1B, a MEMS device 10 having a main MEMS switch 12 is illustrated according to the prior art. The main MEMS switch 12 is formed on an appropriate substrate 14. The main MEMS switch 12 includes a cantilever 16, which is formed from a conductive material, such as gold. The cantilever 16 has a first end and a second end. The first end is coupled to the substrate 14 by an anchor 18. The first end of the cantilever 16 is also electrically coupled to a first conductive pad 20 at or near the point where the cantilever 16 is anchored to the semiconductor substrate 14. Notably, the first conductive pad 20 may play a role in anchoring the first end of the cantilever 16 to the semiconductor substrate 14 as depicted. The first conductive pad 20 may form a portion of or be connected to a first terminal (not shown) of the main MEMS switch 12.

The second end of the cantilever 16 forms or is provided with a cantilever contact 22, which is suspended over a terminal contact 24 formed or provided by a second conductive pad 26. The second conductive pad 26 may form a portion of or be connected to a second terminal (not shown) of the main MEMS switch 12. Thus, when the main MEMS switch 12 is actuated, the cantilever 16 moves the cantilever contact 22 into electrical contact with the terminal contact 24 of the second conductive pad 26 to electrically connect the first conductive pad 20 to the second conductive pad 26. The main MEMS switch 12 may be encapsulated by one or more encapsulating layers 30, which form a substantially hermetically sealed cavity around the cantilever 16. The cavity is generally filled with an inert gas and sealed in a near vacuum state. Once the encapsulation layers 30 are in place, an overmold 32 may be provided over the encapsulation layers 30.

To actuate the main MEMS switch 12, and in particular to cause the cantilever 16 to move the cantilever contact 22 into contact with the terminal contact 24 of the second conductive pad 26, an actuator plate 28 is formed over a portion of the substrate 14, preferably under the middle portion of the cantilever 16. To actuate the main MEMS switch 12, an electrostatic voltage is applied to the actuator plate 28. The presence of the electrostatic voltage creates an electromagnetic field that effectively moves the cantilever 16 against a restoring force toward the actuator plate 28 from an "open" position illustrated in FIG. 1A to a "closed" position illustrated in FIG. 1B. Likewise, removing the electrostatic voltage from the actuator plate 28 releases the cantilever 16 for return to the open position illustrated in FIG. 1A. As illustrated, the open position occurs when the cantilever contact 22 is out of contact with the terminal contact 24, and the closed position occurs when the cantilever contact 22 comes into contact with the terminal contact 24. Other embodiments may differ.

In light of the electromechanical structure of the main MEMS switch 12, the main MEMS switch 12 cannot provide switching action as fast as typical solid state switches, such as n-type metal-oxide-semiconductor (NMOS) FET switches. The switching time of the main MEMS switch 12 typically depends upon the electromagnetic field applied to the cantilever 16, the mass of the cantilever 16, and the restoring force of the cantilever 16. However, an FET switch may generate higher insertion loss than is generated by the main MEMS switch 12. Moreover, at high power levels in an RF circuit (not shown), parasitic capacitance at the semiconductor junctions of the FET switch may alter RF signals.

During switching events, a difference in potential between the cantilever contact 22 and the terminal contact 24 may cause an electrical arc resulting from an electrical current flowing through normally non-conductive media, such as air. Undesired or unintended electrical arcing may have detrimental effects on the cantilever contact 22 and the terminal contact 24 of the main MEMS switch 12. For instance, as the main MEMS switch 12 is being either actuated to the closed position of FIG. 1B or released to the open position of FIG. 1A, arcing from a difference in potential between the cantilever contact 22 and the terminal contact 24 may cause significant aging, unintended wear and tear, degradation, sticking, or destruction of the cantilever contact 22, the terminal contact 24, or both. Unintended power dissipation through arcing should be limited for optimum contact lifetime of the cantilever contact 22 and the terminal contact 24.

A need exists for establishing a common potential at the cantilever contact 22 and terminal contact 24 of the main MEMS switch 12 as the main MEMS switch 12 is being closed or opened, thereby decreasing switch contact aging, degradation, sticking, or destruction by minimizing arcing, while also maintaining the advantages of minimizing insertion losses and maximizing switch isolation and linearity achieved by utilizing the main MEMS switch 12.

SUMMARY OF THE INVENTION

The present invention provides pilot switch circuitry that is coupled across first and second terminals of a microelectromechanical system (MEMS) switch to reduce or eliminate arcing between a cantilever contact and a terminal contact when the MEMS switch is opened or closed. The MEMS switch includes a cantilever that is connected to the first terminal at a first end and provides the cantilever contact at a second end. The cantilever moves the cantilever contact against the terminal contact when the MEMS switch is closed. The pilot switch circuitry establishes a common potential at the first and second terminals prior to, and preferably until, the cantilever contact and terminal contact come into contact with one another when the MEMS switch is closed. Providing a common potential at the first and second terminals provides a common potential at the cantilever contact and terminal contact as the MEMS switch is being closed, thereby reducing or eliminating arcing between the cantilever contact and the terminal contact. The pilot switch circuitry may also establish a common potential at the first and second terminals prior to, and preferably after, the cantilever contact and terminal contact separate from one another when the MEMS switch is opened.

Those skilled in the art will appreciate the scope of the present invention and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the invention, and together with the description serve to explain the principles of the invention.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

The present invention provides pilot switch circuitry that is coupled across first and second terminals of a microelectromechanical system (MEMS) switch to reduce or eliminate arcing between a cantilever contact and a terminal contact when the MEMS switch is opened or closed. The MEMS switch includes a cantilever that is connected to the first terminal at a first end and provides the cantilever contact at a second end. The cantilever moves the cantilever contact against the terminal contact when the MEMS switch is closed. The pilot switch circuitry establishes a common potential at the first and second terminals prior to, and preferably until, the cantilever contact and terminal contact come into contact with one another when the MEMS switch is closed. Providing a common potential at the first and second terminals provides a common potential at the cantilever contact and terminal contact as the MEMS switch is being closed, thereby reducing or eliminating arcing between the cantilever contact and the terminal contact. The pilot switch circuitry may also establish a common potential at the first and second terminals prior to, and preferably after, the cantilever contact and terminal contact separate from one another when the MEMS switch is opened.

Figure 2:
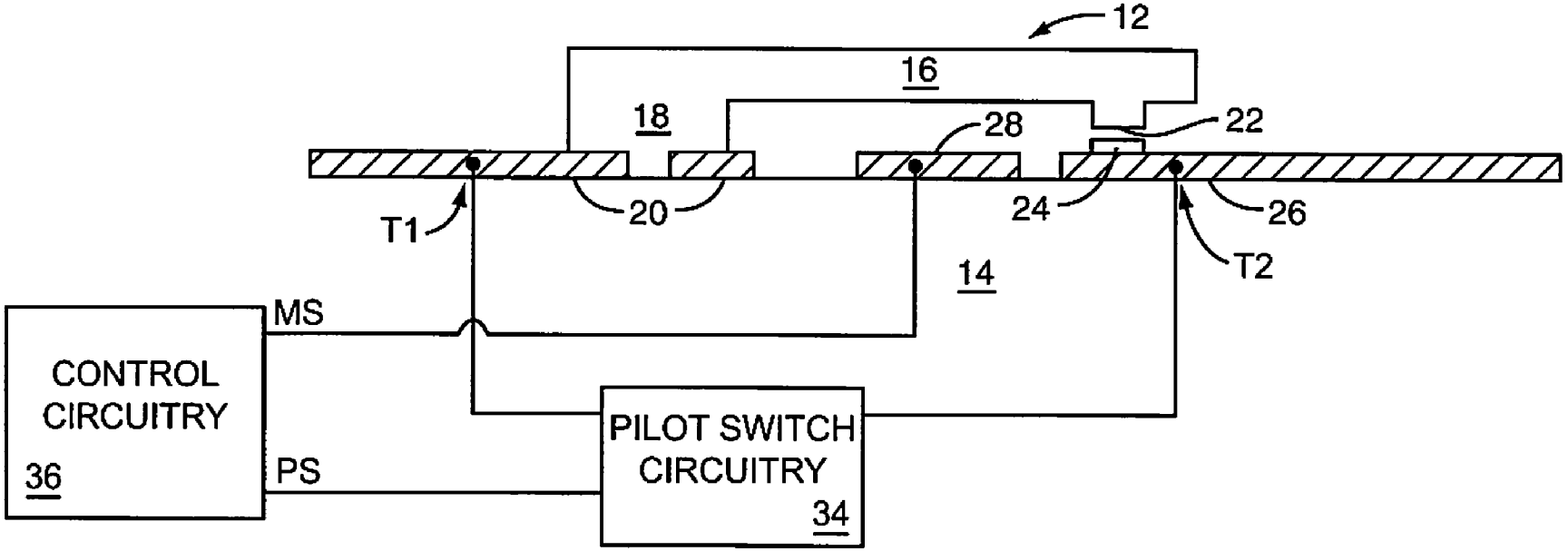
FIG. 2 illustrates a block representation of pilot switch circuitry coupled to terminals of the MEMS switch illustrated in FIG. 1A according to one embodiment of the present invention.

FIG. 2 illustrates a block representation of pilot switch circuitry 34 coupled to the first conductive pad 20 through a first terminal T1 and the second conductive pad 26 through a second terminal T2, according to one embodiment of the present invention. Control circuitry 36 is coupled to the actuator plate 28 and provides a MEMS switch control signal MS to control actuation of the main MEMS switch 12. The control circuitry 36 is also coupled to the pilot switch circuitry 34 and provides a pilot switch control signal PS to control operation of the pilot switch circuitry 34. The pilot switch circuitry 34 establishes a common potential at the first and second terminals T1, T2 prior to, and preferably until, the cantilever contact 22 and the terminal contact 24 come into contact with one another when the main MEMS switch 12 is closed. Providing the common potential at the first and second terminals T1, T2 provides a substantially common potential at the cantilever contact 22 and the terminal contact 24 as the main MEMS switch 12 is being closed, thereby reducing or eliminating arcing between the cantilever contact 22 and the terminal contact 24. The pilot switch circuitry 34 may also establish the common potential at the first and second terminals T1, T2 prior to, and preferably after, the cantilever contact 22 and the terminal contact 24 separate from one another when the main MEMS switch 12 is opened. In an exemplary embodiment of the present invention, the common potential at the first and second terminals T1, T2 provides a substantially common potential at the cantilever contact 22 and the terminal contact 24 such that a potential difference between the cantilever contact 22 and the terminal contact 24 is approximately zero volts. In an alternate embodiment of the present invention, the common potential at the first and second terminals T1, T2 provides a substantially common potential at the cantilever contact 22 and the terminal contact 24 to reduce or prevent arcing between the cantilever contact 22 and the terminal contact 24 compared to opening or closing the MEMS switch 12 without establishing the common potential. The substantially common potential may not be zero volts, but is low enough to reduce or prevent arcing.

Figure 3A:
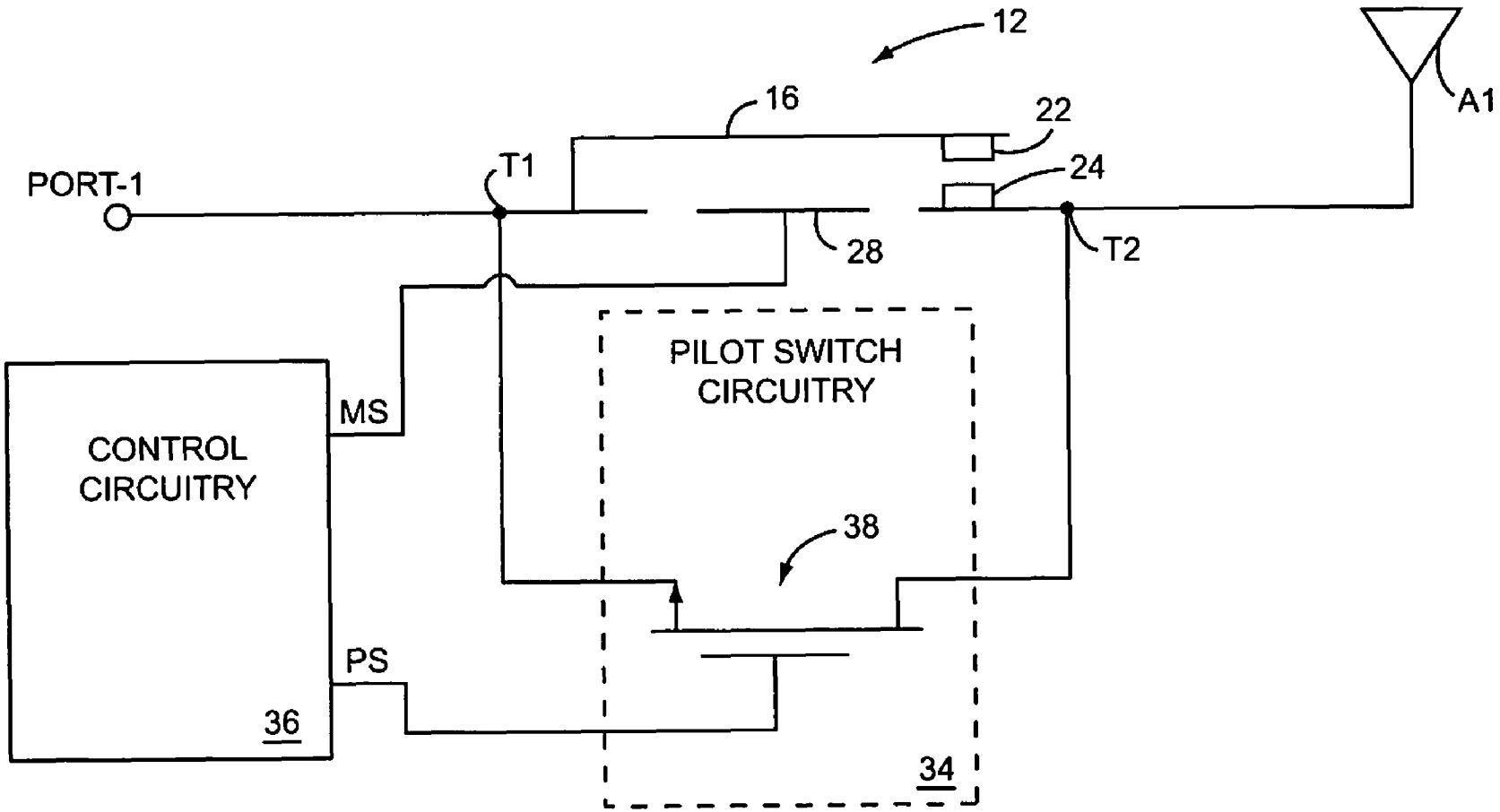
FIG. 3A shows details of a first embodiment of the pilot switch circuitry illustrated in FIG. 2.

FIG. 3A shows a schematic representation of the main MEMS switch 12 coupled at the first terminal T1 to a port PORT-1 and coupled at the second terminal T2 to an antenna A1, for instance. In one embodiment, the pilot switch circuitry 34 comprises a pilot field effect transistor (FET) 38, such as an n-type metal-oxide-semiconductor (NMOS) FET, with a source coupled to the first terminal T1, a drain coupled to the second terminal T2, and a gate coupled to the control circuitry 36. The gate is operable by the pilot switch control signal PS.

Figure 1A:
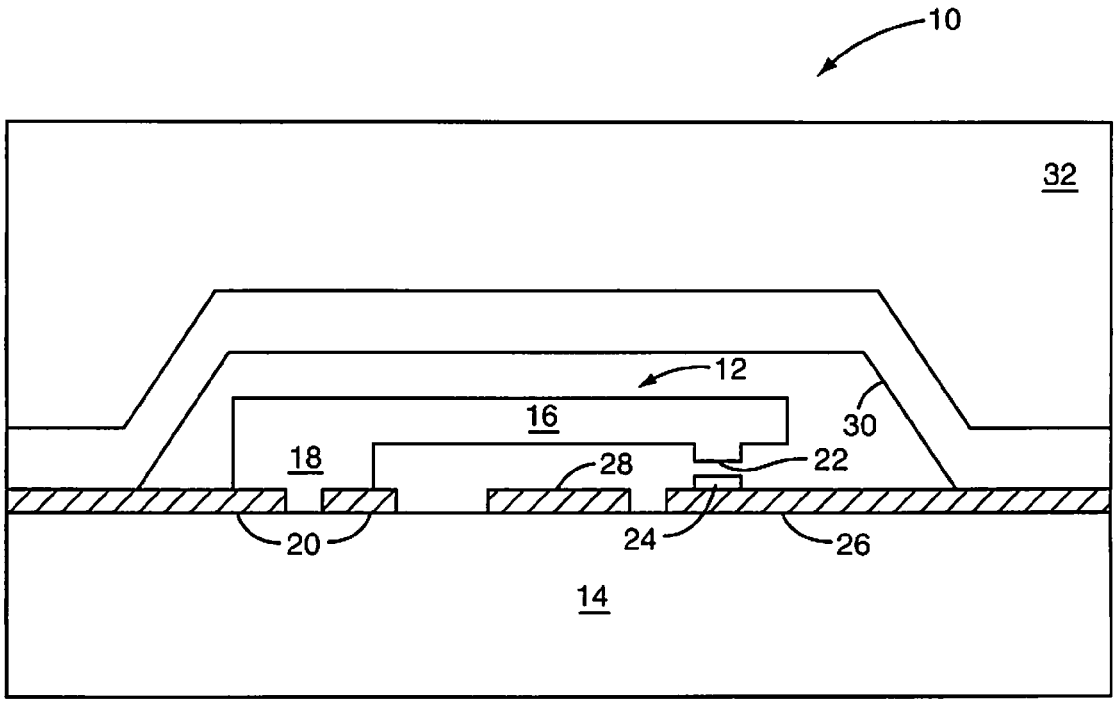
FIG. 1A PRIOR ART
FIGS. 1A and 1B illustrate a microelectromechanical system (MEMS) switch in an open and closed position, respectively, according to the prior art.
Figure 1B:
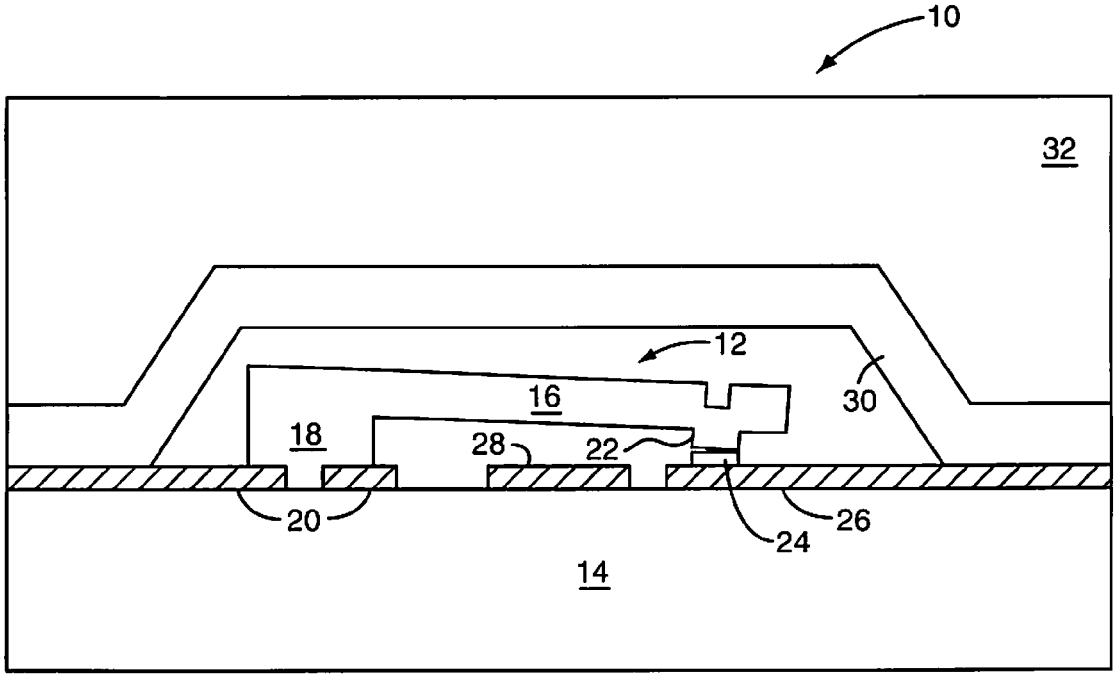
FIG. 1B PRIOR ART

The pilot switch control signal PS operates the gate to switch the pilot FET 38 to a conductive "ON" state, establishing the common potential at the first and second terminals T1, T2 prior to, and preferably until, the cantilever contact 22 and the terminal contact 24 come into contact with one another when the main MEMS switch 12 is closed by moving the cantilever 16 from the open position illustrated in FIG. 1A to the closed position illustrated in FIG. 1B. With the common potential at the first and second terminals T1, T2, the main MEMS switch 12 may be closed with reduced or no damage due to arcing that may otherwise occur from a difference in potential between the cantilever contact 22 and the terminal contact 24. Next, the MEMS switch control signal MS actuates the actuator plate 28, thereby closing the main MEMS switch 12 as illustrated in FIG. 1B.

After the cantilever contact 22 and the terminal contact 24 come into contact with one another and while the main MEMS switch 12 stays in the closed position, the pilot switch control signal PS may operate the gate to switch the pilot FET 38 to a non-conductive "OFF" state, thereby removing the common potential at the first and second terminals T1, T2. As known in the art, the pilot FET 38 in the non-conductive "OFF" state may introduce parasitics, such as parasitic capacitance to ground or nearby signals.

To protect the main MEMS switch 12 from arcing damage when the main MEMS switch 12 is released to the open position again, the process of establishing a common potential at the first and second terminals T1, T2 may be repeated. By first switching the pilot FET 38 to the conductive "ON" state, the common potential may be maintained at the first and second terminals T1, T2 prior to, and preferably after, the cantilever contact 22 and the terminal contact 24 come out of contact with one another when the main MEMS switch 12 is opened. The MEMS switch control signal MS may operate the actuator plate 28 of the MEMS switch 12 to release the cantilever 16 to move from the closed position illustrated in FIG. 1B to the open position illustrated in FIG. 1A. Thereafter, the pilot switch control signal PS may operate the gate to switch the pilot FET 38 to the non-conductive "OFF" state once again.

Figure 3B:
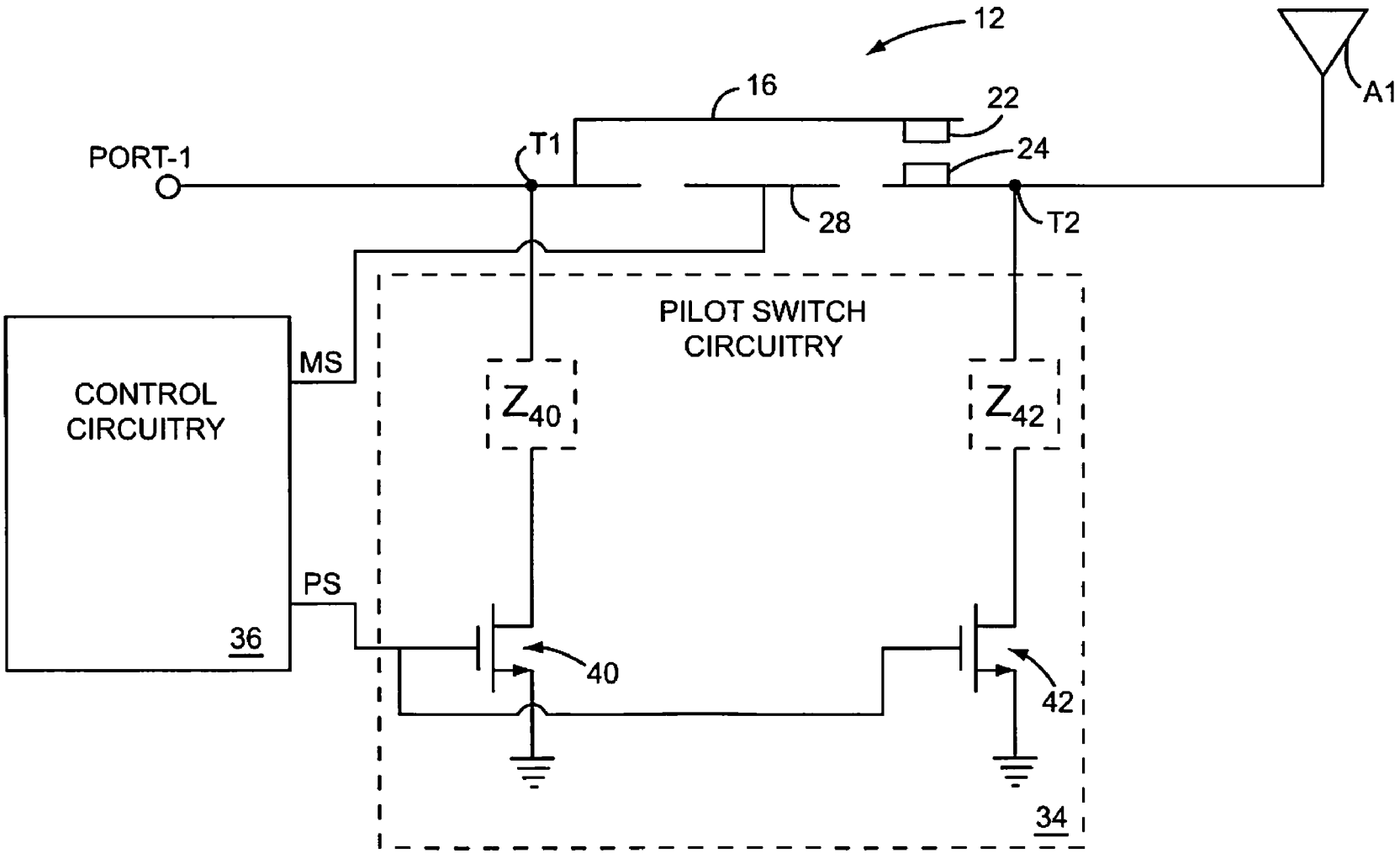
FIG. 3B shows details of a second embodiment of the pilot switch circuitry illustrated in FIG. 2.

FIG. 3B shows a schematic representation of the main MEMS switch 12 of FIG. 3A with the pilot switch circuitry 34 comprising a first pilot FET 40 and a second pilot FET 42. The first pilot FET 40 has a drain coupled to the first terminal T1, and the second pilot FET 42 has a drain coupled to the second terminal T2. The first and second pilot FETs 40, 42 have respective sources coupled to ground or another common reference. The first and second pilot FETs 40, 42 have respective gates coupled to the control circuitry 36. The gates may be operable by the pilot switch control signal PS either together or separately. As known in the art, the first and second pilot FETs 40, 42 may introduce respective impedances $Z_{40}$, $Z_{42}$, respectively, between the first and second terminals T1, T2 and ground or other common reference.

In operation, the pilot switch control signal PS operates the gates to switch the first and second pilot FETs 40, 42 to the conductive "ON" state, establishing the common potential at the first and second terminals T1, T2 prior to, and preferably until, the cantilever contact 22 and the terminal contact 24 come into contact with one another. Switching the first and second pilot FETs 40, 42 to the conductive "ON" state may be done in either order. With the common potential at the first and second terminals T1, T2, the main MEMS switch 12 may be closed with reduced or no damage due to arcing that may otherwise occur from a difference in potential between the cantilever contact 22 and the terminal contact 24. Next, the MEMS switch control signal MS actuates the actuator plate 28, thereby closing the main MEMS switch 12.

After the cantilever contact 22 and the terminal contact 24 come into contact with one another and while the main MEMS switch 12 stays in the closed position, the pilot switch control signal PS may operate the gates to switch the first and second pilot FETs 40, 42 to the non-conductive "OFF" state, thereby removing the common potential at the first and second terminals T1, T2. As known in the art, the first and second pilot FETs 40, 42 in the non-conductive "OFF" state may introduce parasitics, such as parasitic capacitance to ground or nearby signals.

The main MEMS switch 12 may be protected from arcing damage when the main MEMS switch 12 is released to the open position again by repeating the process of establishing a common potential. The common potential may be established at the first and second terminals T1, T2 by switching the first and second pilot FETs 40, 42 to the conductive "ON" state, as described for FIG. 3B above. Next, the main MEMS switch 12 may be opened by operating the actuator plate 28 with the MEMS switch control signal MS to release the cantilever 16 to move to the open position as illustrated in FIG. 1A. Thereafter, the pilot switch control signal PS may operate the gates to switch the FETs 40, 42 to the non-conductive "OFF" state once again.

Figure 3C:
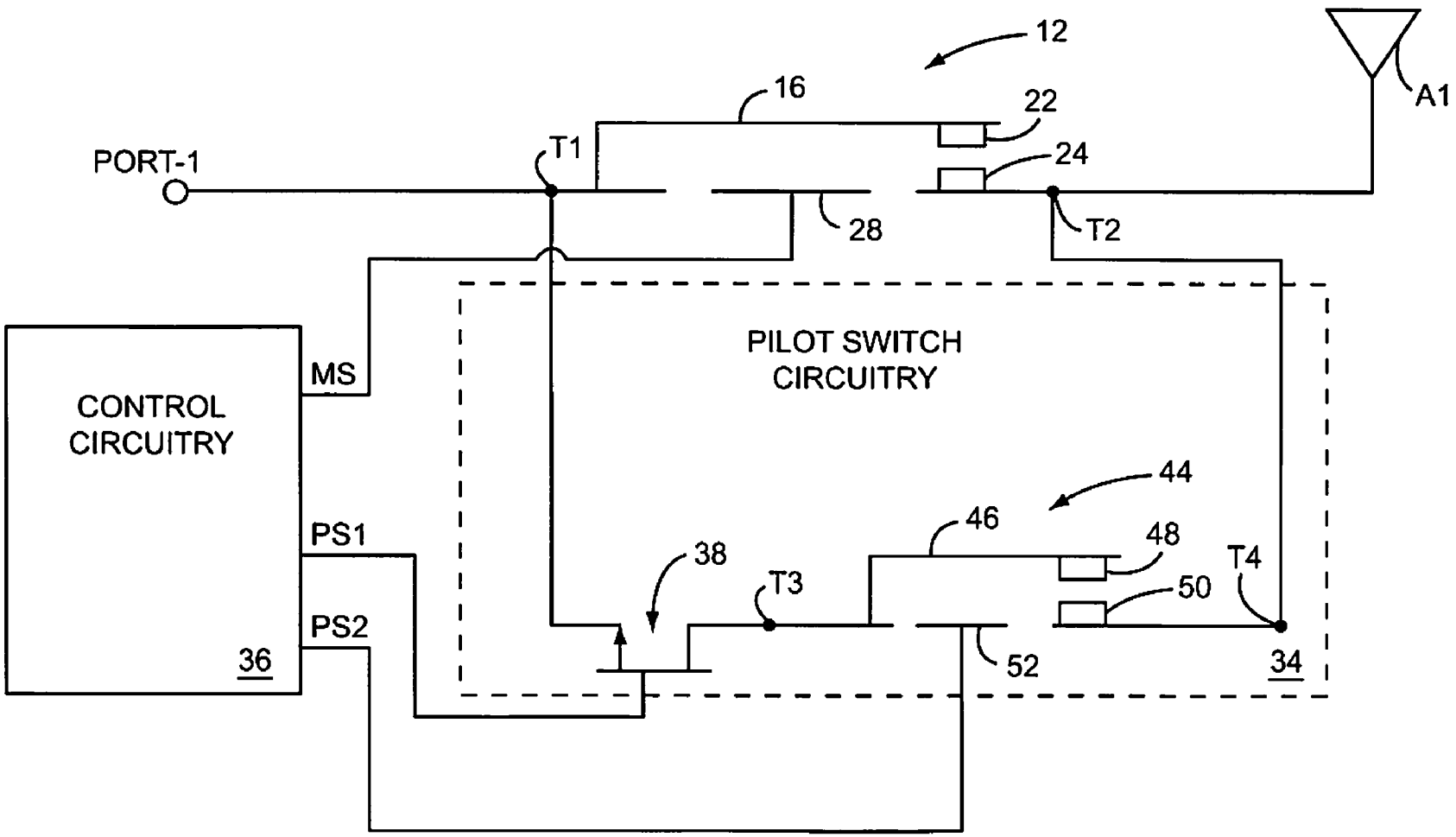
FIG. 3C shows details of a third embodiment of the pilot switch circuitry illustrated in FIG. 2.

FIG. 3C shows a schematic representation of the main MEMS switch 12 of FIG. 3A with the pilot switch circuitry 34 comprising the pilot FET 38 coupled in series with a pilot MEMS switch 44. The pilot FET 38 has the source coupled to the first terminal T1, the drain coupled to a third terminal T3, and the gate coupled to the control circuitry 36. The gate is operable by a first pilot switch control signal PS1.

The pilot MEMS switch 44 has a cantilever 46 coupled between the third terminal T3 and a cantilever contact 48. A terminal contact 50 is coupled to a fourth terminal T4, which is coupled to the second terminal T2 of the main MEMS switch 12. An actuator plate 52 is coupled to the control circuitry 36 to be operable by a second pilot switch control signal PS2.

In operation, the pilot switch control signals PS1, PS2 operate the gate and the actuator plate 52, respectively, to switch the pilot FET 38 to the conductive "ON" state and to close the pilot MEMS switch 44, establishing the common potential at the first and second terminals T1, T2 prior to, and preferably until, the main MEMS switch 12 is actuated into the closed position illustrated in FIG. 1B. According to one embodiment of the present invention, the second pilot switch control signal PS2 first operates the actuator plate 52 of the pilot MEMS switch 44 while the pilot FET 38 is in the non-conductive "OFF" state, thereby closing the pilot MEMS switch 44 with reduced or no damage due to arcing that may otherwise occur from a difference in potential between the cantilever contact 48 and the terminal contact 50 of the pilot MEMS switch 44. The second pilot switch control signal PS2 operates the actuator plate 52, thereby closing the pilot MEMS switch 44 by moving the cantilever 46 from the open position as illustrated in FIG. 1A to the closed position as illustrated in FIG. 1B.

After the pilot MEMS switch 44 is closed, and while the pilot MEMS switch 44 stays in the closed position, the first pilot switch control signal PS1 operates the gate to switch the pilot FET 38 to the conductive "ON" state. A conductive path through the pilot FET 38 and the pilot MEMS switch 44 establishes the common potential at the first and second terminals T1, T2. With the common potential at the first and second terminals T1, T2, the main MEMS switch 12 may be closed with reduced or no damage due to arcing that may otherwise occur from a difference in potential between the cantilever contact 22 and the terminal contact 24. Next, the MEMS switch control signal MS actuates the actuator plate 28, thereby closing the main MEMS switch 12.

After the main MEMS switch 12 is closed, and while the main MEMS switch 12 stays in the closed position, the first pilot switch control signal PS1 may operate the gate to switch the pilot FET 38 to the non-conductive "OFF" state, thereby opening the conductive path through the pilot FET 38 between the first and second terminals T1, T2. The pilot FET 38 in the non-conductive "OFF" state may introduce parasitics, such as parasitic capacitance to ground or nearby signals. The second pilot switch control signal PS2 may operate the actuator plate 52 to release the cantilever 46 of the pilot MEMS switch 44 to move from the closed position as illustrated in FIG. 1B to the open position as illustrated in FIG. 1A. Switching the pilot MEMS switch 44 to the open position may conserve power.

The main MEMS switch 12 may be protected from arcing damage when the main MEMS switch 12 is released to the open position again by repeating the process of establishing a common potential. The common potential may be established at the first and second terminals T1, T2 by switching the pilot MEMS switch 44 to the conductive closed position first, and then switching the pilot FET 38 to the conductive "ON" state, as described above. Next, the main MEMS switch 12 may be opened by operating the actuator plate 28 with the MEMS switch control signal MS to release the cantilever 16 of the MEMS switch 12 to move to the open position. Thereafter, the first pilot switch control signal PS1 may operate the gate to switch the pilot FET 38 to the "OFF" state, followed by the second switch control signal PS2 operating the actuator plate 52 to switch the pilot MEMS switch 44 to the open position once again. With both MEMS switches 12, 44 in their open positions, mechanical isolation is provided between the antenna A1 and the port PORT-1. The mechanical isolation may significantly reduce or eliminate leakage currents, non-linearities, or other effects.

Figure 4:
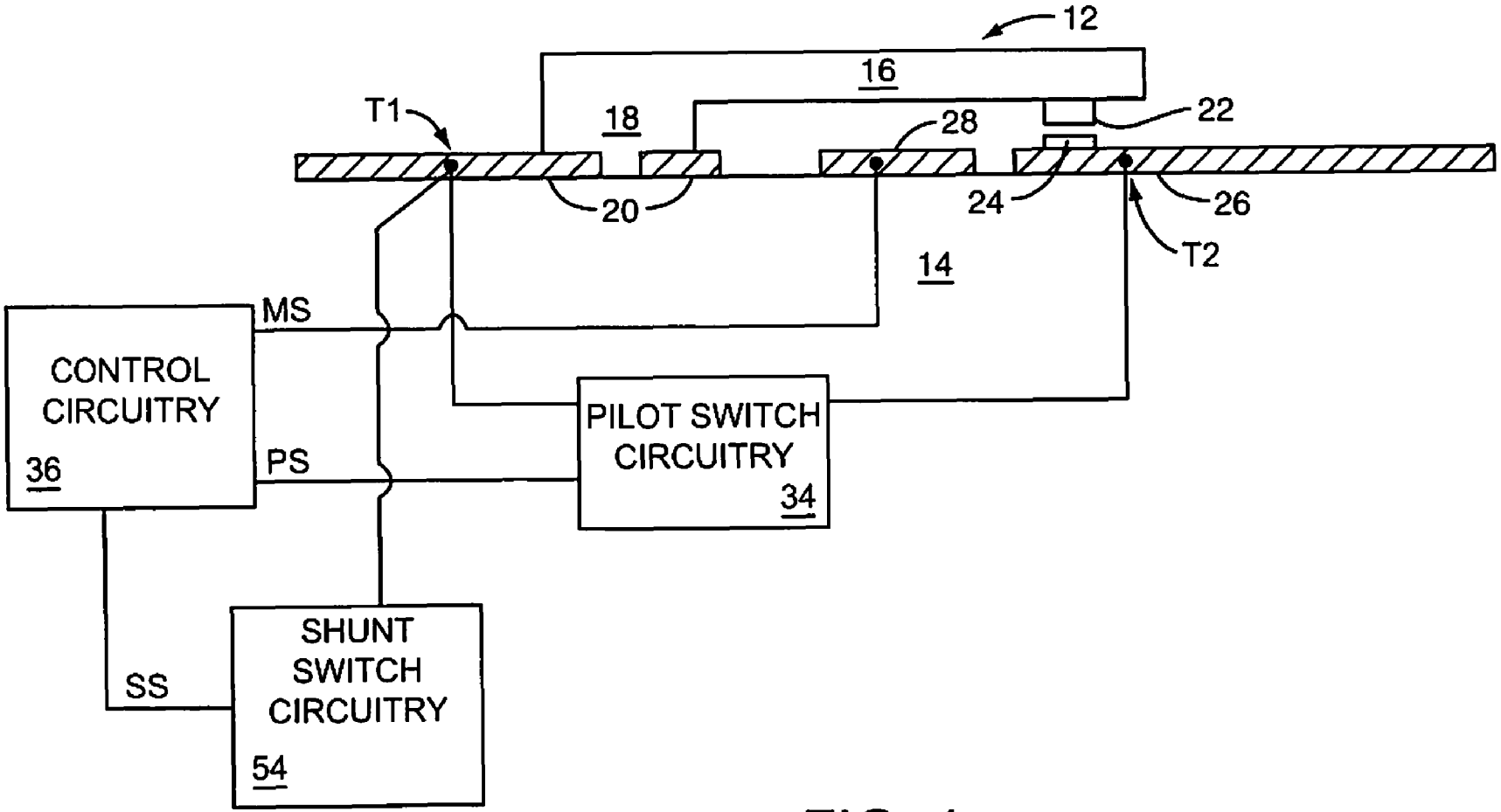
FIG. 4 illustrates a block representation of pilot switch circuitry and shunt switch circuitry coupled to terminals of the MEMS switch illustrated in FIG. 1A according to an alternate embodiment of the present invention.

FIG. 4 illustrates a block representation of the pilot switch circuitry 34 and shunt switch circuitry 54 coupled to the main MEMS switch 12 of FIG. 1A with associated control circuitry 36, according to an alternate embodiment of the present invention. The pilot switch circuitry 34 is coupled to the first terminal T1 and the second terminal T2 of the main MEMS switch 12 of FIG. 1A. Additionally, the shunt switch circuitry 54 is coupled to the first terminal T1. The control circuitry 36 is coupled to the actuator plate 28 and provides the MEMS switch control signal MS to control actuation of the main MEMS switch 12. The control circuitry 36 is also coupled to the pilot switch circuitry 34 and provides the pilot switch control signal PS to control operation of the pilot switch circuitry 34. Moreover, the control circuitry 36 is coupled to the shunt switch circuitry 54 and provides a shunt switch control signal SS to control operation of the shunt switch circuitry 54.

The shunt switch circuitry 54 establishes an electrical path to ground through which excess current may be discharged, improving isolation of the pilot switch circuitry 34. The shunt switch circuitry 54 may become necessary depending upon possible connections to the port PORT-1 (see FIGS. 3A-3C). For instance, during any receive mode, if the port PORT-1 provides an input to a low noise amplifier (not shown), then the shunt switch circuitry 54 may be switched to the non-conductive "OFF" position to provide the low noise amplifier with an unobstructed electrical path to the antenna A1. Further, during a transmit mode with a power amplifier (not shown) providing high power to the antenna A1, the shunt switch circuitry 54 may be switched to the conductive "ON" position to decrease any current leakage through the pilot switch circuitry 34 below a damage threshold.

Figure 5A:
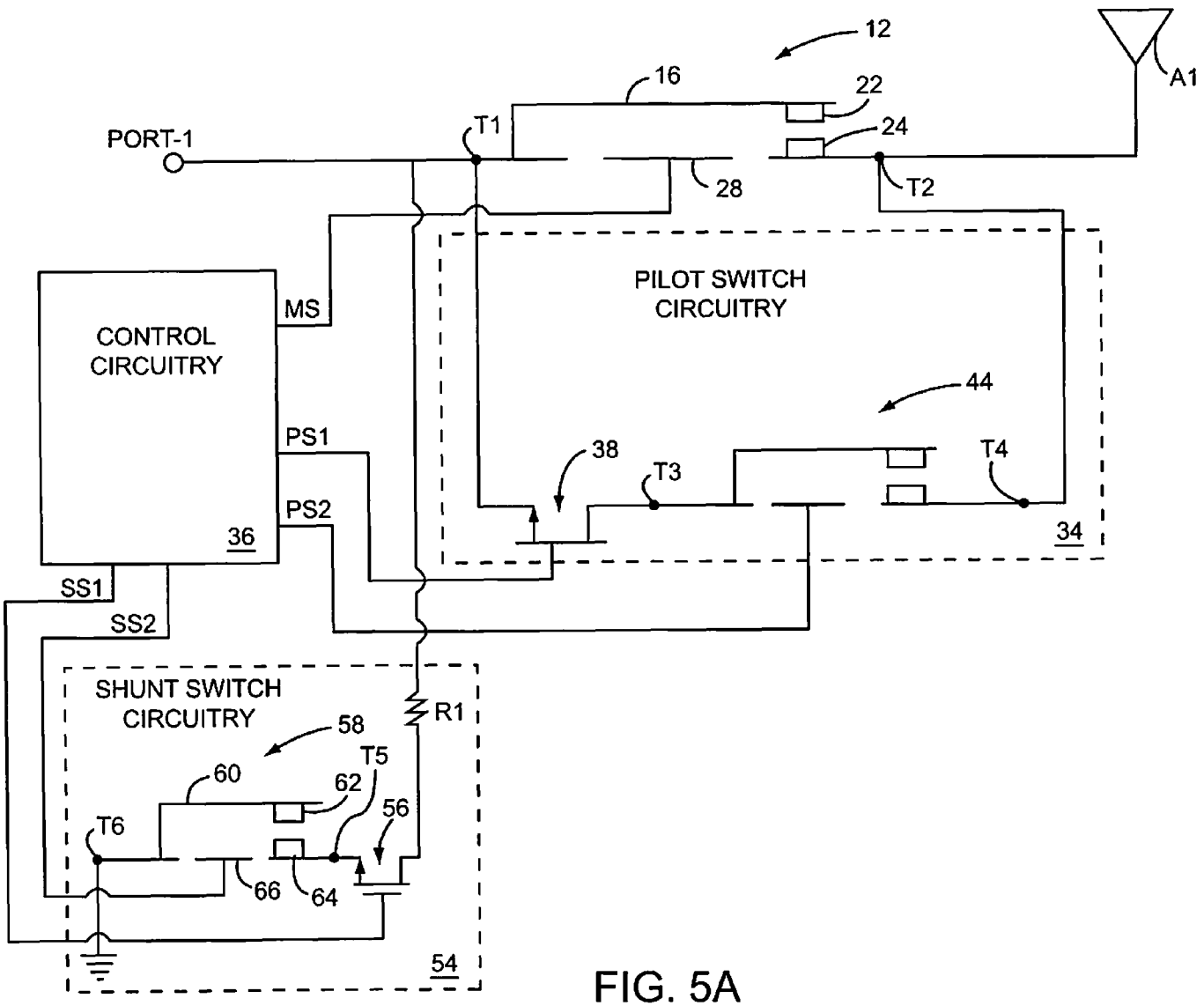
FIG. 5A shows details of a first embodiment of the shunt switch circuitry illustrated in FIG. 4.

FIG. 5A shows the circuit of FIG. 3C with a first embodiment of the shunt switch circuitry 54 coupled in parallel between the first terminal T1 and ground. The shunt switch circuitry 54 comprises a termination resistance R1, a shunt FET 56, and a first shunt MEMS switch 58. The termination resistance R1 is shown coupled between the first terminal T1 and a drain of the shunt FET 56. In light of the inherent impedance of the shunt FET 56, the termination resistance R1 may optionally be omitted to provide an alternate short circuit to ground. A source of the shunt FET 56 is coupled to a fifth terminal T5, and a gate is coupled to the control circuitry 36. The gate is fed from a first shunt switch control signal SS1.

The first shunt MEMS switch 58 has a cantilever 60 coupled between a sixth terminal T6 and a cantilever contact 62. As shown in FIG. 5A, the sixth terminal T6 is coupled to ground. A terminal contact 64 is coupled to the fifth terminal T5. An actuator plate 66 is coupled to the control circuitry 36 to be operable by a second shunt switch control signal SS2.

In operation, the main MEMS switch 12 and the pilot switch circuitry 34 are controlled with the control circuitry 36 in the manner described for FIG. 3C. Further, the shunt switch circuitry 54 may be operated independently from the pilot switch circuitry 34, and the main MEMS switch 12 may be either in the open position illustrated in FIG. 1A or the closed position illustrated in FIG. 1B. With the shunt FET 56 operating in the non-conductive "OFF" state, the first shunt MEMS switch 58 may be closed with reduced or no damage due to arcing that may otherwise occur from a difference in potential between the cantilever contact 62 and the terminal contact 64. The second shunt switch control signal SS2 operates the actuator plate 66, thereby closing the first shunt MEMS switch 58 by moving the cantilever 60 from the open position similarly shown in FIG. 1A to the closed position similarly shown in FIG. 1B.

After the first shunt MEMS switch 58 is closed, and while the first shunt MEMS switch 58 stays in the closed position, the first shunt switch control signal SS1 operates the gate to switch the shunt FET 38 to the conductive "ON" state. A conductive path through the pilot FET 38 and the pilot MEMS switch 44 establishes a shunt path from the first terminal T1 to ground at the sixth terminal T6, thereby discharging excess current, improving isolation of the pilot switch circuitry 34.

To switch the first shunt MEMS switch 58 to the non-conductive open position similarly shown in FIG. 1A, the first shunt switch control signal SS1 may initially operate the gate to switch the shunt FET 56 to the non-conductive "OFF" state, thereby reducing or eliminating any potential at the fifth and sixth terminals T5, T6. With the shunt FET 56 in the non-conductive "OFF" state, and with the fifth and sixth terminals T5, T6 at the common potential of ground, the second shunt switch control signal SS2 may operate the actuator plate 66 to release the cantilever 60 to move to the open position similar to that shown in FIG. 1A, thereby switching the first shunt MEMS switch 58 to the non-conductive open position. Switching the first shunt MEMS switch 58 to the open position provides an open mechanical switch that provides mechanical isolation between the first terminal T1 and ground. The mechanical isolation may significantly reduce or eliminate leakage currents, non-linearities, or other effects. However, the shunt FET 56 in the non-conductive "OFF" state may introduce parasitics, such as leakage current, non-linearities, or parasitic capacitance. As such, a second shunt MEMS switch 68 may be utilized as shown and described in FIG. 5B.

Figure 5B:
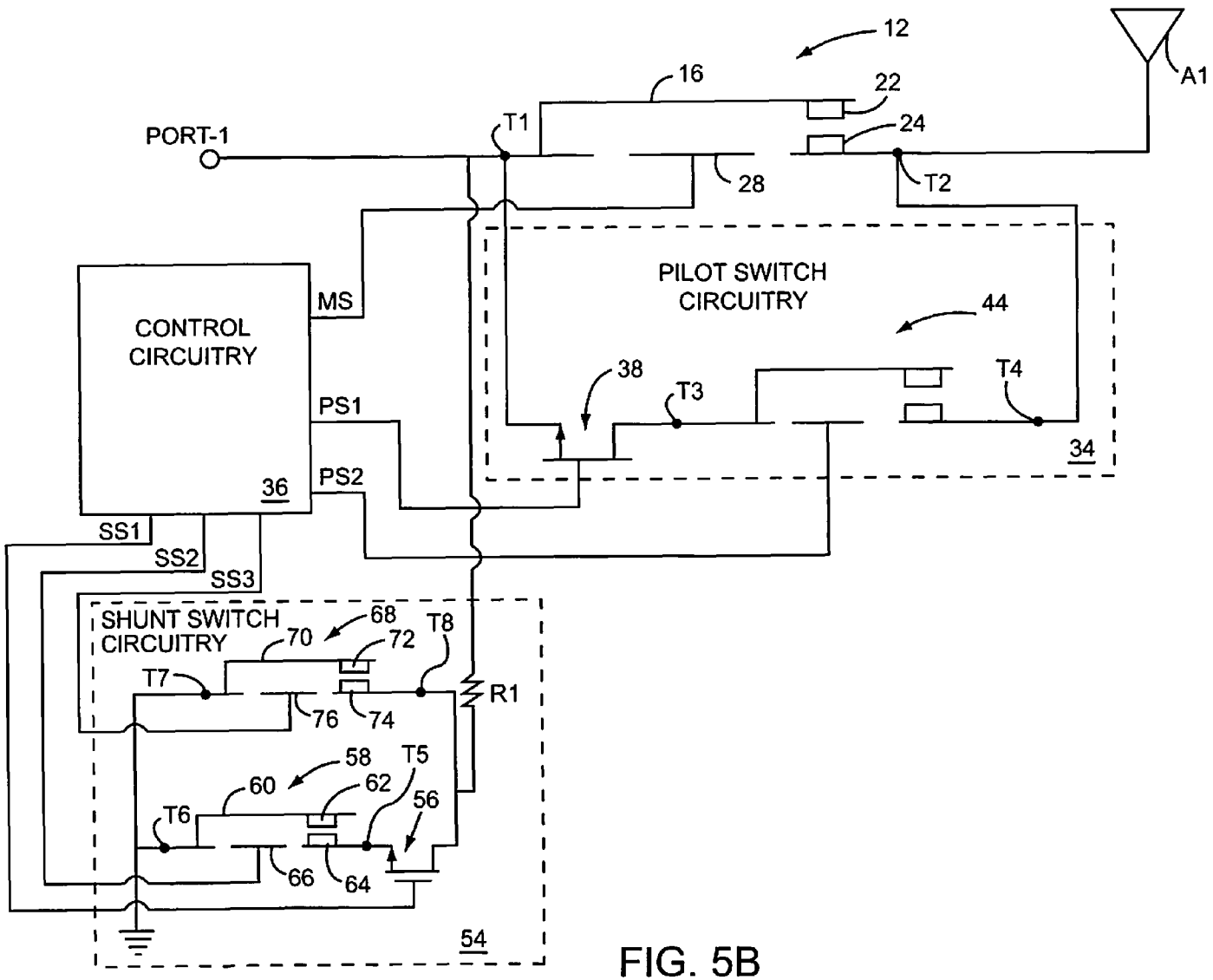
FIG. 5B shows details of a second embodiment of the shunt switch circuitry illustrated in FIG. 4.

FIG. 5B shows the circuit of FIG. 3C with a second embodiment of shunt switch circuitry 54 coupled in parallel between the first terminal T1 and ground. The shunt switch circuitry 54 comprises the termination resistance R1, the shunt FET 56, and the first shunt MEMS switch 58, all described in FIG. 5A. Additionally, the shunt switch circuitry 54 further comprises a second shunt MEMS switch 68 having a cantilever 70 coupled between a seventh terminal T7 and a cantilever contact 72. As shown in FIG. 5B, the seventh terminal T7 is coupled to the sixth terminal T6, which is coupled to ground. A terminal contact 74 is coupled to an eighth terminal T8, which is also coupled to the drain of the shunt FET 56 and the termination resistance R1. An actuator plate 76 is coupled to the shunt switch circuitry 54 to be operable by a third shunt switch control signal SS3.

In operation, and similar to the description for FIG. 5A, the shunt switch circuitry 54 of FIG. 5B may be operated independently from the pilot switch circuitry 34, and the main MEMS switch 12 may be either in the open position illustrated in FIG. 1A or the closed position illustrated in FIG. 1B. With the shunt FET 56 operating in the non-conductive "OFF" state, the first shunt MEMS switch 58 may be closed with reduced or no damage due to arcing that may otherwise occur from a difference in potential between the cantilever contact 62 and the terminal contact 64. The second shunt switch control signal SS2 operates the actuator plate 66, thereby closing the first shunt MEMS switch 58 by moving the cantilever 60 from the open position, as illustrated in FIG. 1A, to the closed position, as illustrated in FIG. 1B.

After the first shunt MEMS switch 58 is closed, and while the first shunt MEMS switch 58 stays in the closed position, the first shunt switch control signal SS1 operates the gate to switch the shunt FET 56 to the conductive "ON" state. A conductive path through the shunt FET 56 and the first shunt MEMS switch 58 establishes the common potential at the seventh and eighth terminals T7, T8. With the common potential at the seventh and eighth terminals T7, T8, the second shunt MEMS switch 68 may be closed with reduced or no damage due to arcing that may otherwise occur from a difference in potential between the cantilever contact 72 and the terminal contact 74. Next, the third shunt switch control signal SS3 actuates the actuator plate 76, thereby closing the second shunt MEMS switch 68 by moving the cantilever 70 from the open position, as illustrated in FIG. 1A, to the closed position, as illustrated in FIG. 1B.

After the second shunt MEMS switch 68 is closed, and while the second shunt MEMS switch 68 stays in the closed position, the first shunt MEMS switch 58 may be switched to the non-conductive open position as illustrated in FIG. 1A. The first shunt switch control signal SS1 may operate the gate to switch the shunt FET 56 to the non-conductive "OFF" state, thereby opening the conductive path through the shunt FET 56 between the termination resistance R1 and the fifth terminal T5. The shunt FET 56 in the non-conductive "OFF" state may introduce parasitics, such as parasitic capacitance to ground or nearby signals. As such, with the shunt FET 56 in the non-conductive "OFF" state, the second shunt switch control signal SS2 may operate the actuator plate 66 to release the cantilever 60 of the first shunt MEMS switch 58 to move from the closed position, similarly shown in FIG. 1B, to the open position, similarly shown in FIG. 1A. Switching the first shunt MEMS switch 58 to the open position provides mechanical isolations between the first terminal T1 and ground; however, the second shunt MEMS switch 68 continues to provide a shunt path by operating in the closed position.

To switch the second shunt MEMS switch 68 to the non-conductive open position similarly shown in FIG. 1A, the common potential at the seventh and eighth terminals T7, T8 may be re-established by first switching the first shunt MEMS switch 58 and then the shunt FET 56 to the closed position in the manner described for FIG. 5A. Next, the second shunt MEMS switch 68 may be switched to the open position by operating the actuator plate 76 with the third shunt switch control signal SS3. Thereafter, the shunt FET 56 and then the first shunt MEMS switch 58 may be opened in the manner described for FIG. 5A. Alternate embodiments of the present invention may use an array of pilot switches coupled in parallel with the MEMS switch. Each of the array of pilot switches may be opened or closed in sequence such that prior to opening or closing the MEMS switch, a voltage difference across the MEMS switch is approximately zero, a current through the MEMS switch is approximately zero, or both. The array of pilot switches may include parallel coupled pilot switches, series coupled pilot switches, shunt pilot switches coupled to a DC reference, such as ground, MEMS pilot switches, semiconductor pilot switches, or any combination thereof.

Figure 6:
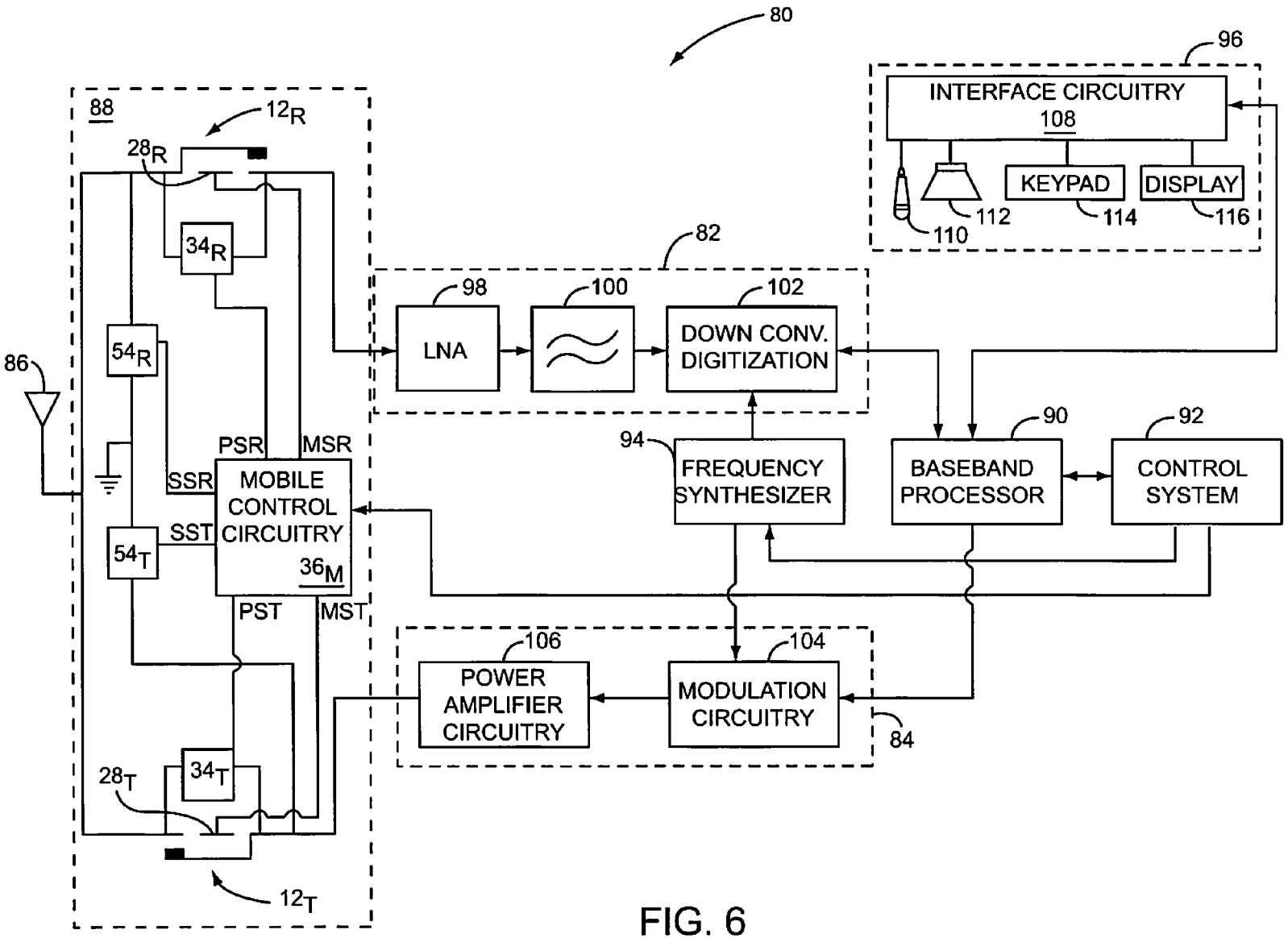
FIG. 6 is a block representation of a mobile terminal incorporating an embodiment of the present invention.

The present invention may be incorporated in various ways in a mobile terminal, such as a mobile telephone, wireless personal digital assistant, or like communication device. In many applications, MEMS switches are being deployed as antenna switches, load switches, transmit/receive switches, tuning switches, and the like. FIG. 6 illustrates an exemplary embodiment where numerous main MEMS switches 12 are employed in a transmit/receive switch of a mobile terminal 80. As illustrated, the mobile terminal 80 may include a receiver front end 82, a transmitter section 84, an antenna 86, and a transmit/receive switch 88, which includes a receive MEMS switch $\mathbf{12}_R$, a transmit MEMS switch $\mathbf{12}_T$, mobile control circuitry $\mathbf{36}_M$, receive pilot switch circuitry $\mathbf{34}_R$, receive shunt switch circuitry $\mathbf{54}_R$, transmit pilot switch circuitry $\mathbf{34}_T$, and transmit shunt switch circuitry $\mathbf{54}_T$. The mobile terminal 80 is capable of operating in one band while using the single antenna 86. One skilled in the art will recognize that additional transmit/receive paths with additional transmit and receive MEMS switches may be added to provide for operation of the mobile terminal 80 in additional bands.

In FIG. 6, the receiver front end 82 is coupled to the antenna 86 through a receive path including the receive MEMS switch $\mathbf{12}_R$. Similarly, the radio frequency transmitter section 84 is coupled to the antenna 86 through a transmit path including the transmit MEMS switch $\mathbf{12}_T$. When receiving, the receive MEMS switch $\mathbf{12}_R$ is closed, while the transmit MEMS switch $\mathbf{12}_T$ is open. When transmitting, the transmit MEMS switch $\mathbf{12}_T$ is closed, while the receive MEMS switch $\mathbf{12}_R$ is open. Thus, signals received by or transmitted from the antenna 86 are selectively routed between the receiver front end 82 and the radio frequency transmitter section 84 based on the receive or transmit mode.

Respective receive and transmit pilot switch circuitry $\mathbf{34}_R$, $\mathbf{34}_T$ may be coupled in parallel across the receive and transmit MEMS switches $\mathbf{12}_R$, $\mathbf{12}_T$, respectively, similar to the manner described in FIG. 4, thereby to protect the receive MEMS switch $\mathbf{12}_R$ in accordance with the present invention. Further, respective receive and transmit shunt switch circuitry $\mathbf{54}_R$, $\mathbf{54}_T$ may be coupled in parallel between ground and the receive and transmit MEMS switches $\mathbf{12}_R$, $\mathbf{12}_T$, respectively, similar to the manner described in FIG. 4, thereby to establish an electrical path to ground and provide isolation and protection as described in FIG. 4.

The mobile control circuitry $\mathbf{36}_M$ controls the receive MEMS switch $\mathbf{12}_R$, the transmit MEMS switch $\mathbf{12}_T$, the receive pilot switch circuitry $\mathbf{34}_R$, the transmit pilot switch circuitry $\mathbf{34}_T$, the receive shunt switch circuitry $\mathbf{54}_R$, and the transmit shunt switch circuitry $\mathbf{54}_T$. The mobile control circuitry $\mathbf{36}_M$ provides a receive MEMS switch control signal MSR, a transmit MEMS switch control signal MST, a receive pilot switch control signal PSR, a transmit pilot switch control signal PST, a receive shunt switch control signal SSR, and a transmit shunt switch control signal SST.

In accordance with one embodiment of the present invention, as similarly described for control of the main MEMS switch 12, pilot switch circuitry 34, and control circuitry 36 of FIG. 4, respective receive and transmit MEMS switch control signals MSR and MST actuate respective actuator plates $\mathbf{28}_R$, $\mathbf{28}_T$, thereby to close the respective receive and transmit MEMS switches $\mathbf{12}_R$, $\mathbf{12}_T$ from the open position (as illustrated in FIG. 1A) to the closed position (as illustrated in FIG. 1B). The respective receive MEMS switches $\mathbf{12}_R$, $\mathbf{12}_T$ stay closed until the respective receive and transmit MEMS switch control signals MSR, MST operates the respective actuator plates $\mathbf{28}_R$, $\mathbf{28}_T$. Also, respective receive and transmit pilot switch control signals PSR, PST control respective receive and transmit pilot switch circuitry $\mathbf{34}_R$, $\mathbf{34}_T$, to establish a common potential across respective receive and transmit MEMS switches $\mathbf{12}_R$, $\mathbf{12}_T$ when such switches are opened or closed, in a manner similar to that illustrated in FIG. 4, thereby protecting respective MEMS switches $\mathbf{12}_R$, $\mathbf{12}_T$. Also, respective receive and transmit shunt switch control signals SSR, SST control respective receive and transmit shunt switch circuitry $\mathbf{54}_R$, $\mathbf{54}_T$ to provide a shunt path to ground, in a manner similar to that described in FIG. 4, thereby protecting various circuit elements.

Continuing with FIG. 6, the mobile terminal 80 further includes a baseband processor 90, a control system 92, a frequency synthesizer 94, and an interface 96. The control system 92 may include or cooperate with the mobile control circuitry $\mathbf{36}_M$ to control the active MEMS switches $\mathbf{12}_R$, $\mathbf{12}_T$ and to equalize the potentials across the active MEMS switches $\mathbf{12}_R$, $\mathbf{12}_T$ during closing and opening, respectively.

The receiver front end 82 receives information bearing radio frequency signals of a given mode from one or more remote transmitters provided by a base station (not shown). A low noise amplifier 98 amplifies the signal. A filter circuit 100 minimizes broadband interference in the received signal, while down conversion and digitization circuitry 102 down converts the filtered, received signal to an intermediate or baseband frequency signal, which is then digitized into one or more digital streams. The receiver front end 82 typically uses one or more mixing frequencies generated by the frequency synthesizer 94.

The baseband processor 90 processes the digitized received signal to extract the information or data bits conveyed in the received signal. This processing typically comprises demodulation, decoding, and error correction operations. As such, the baseband processor 90 is generally implemented in one or more digital signal processors (DSPs).

On the transmit side, the baseband processor 90 receives digitized data, which may represent voice, data, or control information, from the control system 92, which it encodes for transmission. The encoded data is output to the transmitter section 84, where it is used by modulation circuitry 104 to modulate a carrier signal that is at a desired transmit frequency for the given mode. Power amplifier circuitry 106 amplifies the modulated carrier signal to a level appropriate for transmission according to a power control signal, and delivers the amplified and modulated carrier signal to antenna 86 through the transmit/receive switch 88.

A user may interact with the mobile terminal 80 via the interface 96, which may include interface circuitry 108, which is generally associated with a microphone 110, a speaker 112, a keypad 114, and a display 116. The microphone 110 will typically convert audio input, such as the user's voice, into an electrical signal, which is then digitized and passed directly or indirectly to the baseband processor 90. Audio information encoded in the received signal is recovered by the baseband processor 90, and converted by the interface circuitry 108 into an analog signal suitable for driving speaker 112. The keypad 114 and display 116 enable the user to interact with the mobile terminal 80, input numbers to be dialed, address book information, or the like, as well as monitor call progress information.

Those skilled in the art will recognize improvements and modifications to the preferred embodiments of the present invention. The preferred embodiments illustrate a MEMS switch having a three terminal cantilever style; however, alternate embodiments of the present invention, may combine pilot switches with MEMS switches having any style, such as four terminal cantilever MEMS switches, MEMS switches having fixed contact bars with a movable wedge, MEMS switches having suspended plates that short fixed contact arrays, and the like. Additionally, the MEMS switch according to the present invention may be utilized in adaptive loads for power amplifiers. In such case, a matching network may be varied to optimize the performance of an amplifier at different power levels and voltage standing wave ratio (VSWR) conditions. Global System for Mobile Communications (GSM) power amplifiers may have load changes synchronized with the transmit times. Code Division Multiple Access (CDMA) amplifiers may need to adapt loads during active transmit operations. All such improvements and modifications are considered within the scope of the concepts disclosed herein and the claims that follow.

What is claimed is:

1. A microelectromechanical system (MEMS) switch circuit, comprising:

a main MEMS switch having a first terminal, a first contact coupled to the first terminal, a second terminal, and a second contact coupled to the second terminal, and adapted to receive a MEMS switch control signal to control actuation of the main MEMS switch;

pilot switch circuitry comprising a transistor switch and a pilot MEMS switch coupled in series between the first and second terminal, the pilot switch circuitry is adapted to close the pilot MEMS switch and place the transistor switch in a conducting state during an active pilot state; and control circuitry adapted to provide the MEMS switch control signal.

2. The MEMS switch circuit of claim 1, wherein during an inactive pilot state, the pilot switch circuitry is adapted to open the pilot MEMS switch and place the transistor in a non-conducting state.

3. The MEMS switch circuit of claim 2, wherein a potential difference between the first terminal and the second terminal is low enough such that arcing between the first contact and the second contact during the active pilot state is less than arcing between the first contact and the second contact during the inactive pilot state.

4. The MEMS switch circuit of claim 1, wherein the active pilot state is selected prior to and until the main MEMS switch is closed.

5. The MEMS switch circuit of claim 1, wherein the active pilot state is selected prior to and until the main MEMS switch is opened.

6. The MEMS switch circuit of claim 1, wherein during the active pilot state, a potential difference in potential between the first terminal and the second terminal is approximately zero volts.

7. The MEMS switch circuit of claim 1, wherein during the active pilot state, a potential difference between the first terminal and the second terminal is low enough to substantially prevent arcing between the first contact and the second contact.

8. The MEMS switch circuit of claim 1, wherein the comprises a field effect transistor switch (FET) element.

9. A microelectromechanical system (MEMS) switch circuit, comprising:

a main MEMS switch having a first terminal, a first contact coupled to the first terminal, a second terminal, and a second contact coupled to the second terminal, and adapted to receive a MEMS switch control signal to control actuation of the main MEMS switch;

pilot switch circuitry adapted to receive a pilot switch control signal, and provide a first signal to the first terminal and a second signal to the second terminal, such that during an active pilot state, the first and second signals provide a substantially common potential to the first and second contacts;

control circuitry adapted to provide the MEMS switch control signal and the pilot switch control signal;

the control circuitry is further adapted to provide a supplemental pilot switch control signal, which is adapted to select a first supplemental active pilot state, and the pilot switch control signal is adapted to select a second supplemental active pilot state; and the pilot switch circuitry comprises:

a field effect transistor (FET) element with a source coupled to the first terminal of the main MEMS switch, a drain, and a gate adapted to receive the pilot switch control signal, such that during the second supplemental active pilot state, the FET element is in a conductive state; and a pilot MEMS switch with a third terminal coupled to the drain, a fourth terminal coupled to the second terminal of the main MEMS switch, and an actuator plate adapted to receive the supplemental pilot switch control signal, such that during the first supplemental active pilot state, the pilot MEMS switch is in a closed state, wherein the active pilot state is selected by a combination of the first supplemental active pilot state and the second supplemental active pilot state.

10. A method reducing arcing between contacts in a first microelectromechanical system (MEMS) switch comprising:

providing pilot switch circuitry coupled between the contacts of the first MEMS switch, the pilot control circuitry including a transistor switch and a second pilot MEMS switch;

activating the pilot switch circuitry to provide a substantially common potential to the contacts of the first MEMS switch by activating the transistor switch and closing the second MEMS switch;

opening or closing the first MEMS switch whereby activating the pilot switch circuitry reduces the arcing between contacts of the first MEMS switch when the first MEMS switch is being opened or closed; and deactivating the pilot switch circuitry by deactivating the transistor switch and opening the second MEMS switch thereby electrically isolating the pilot switch circuitry.

11. The method of claim 10 further comprising selecting an active pilot state prior to and until the first MEMS switch is closed.

12. The method of claim 10 further comprising selecting an active pilot state prior to and until the first MEMS switch is opened.

13. A method comprising:

coupling an array of pilot switches in parallel with a micromechanical system (MEMS) switch;

opening or closing each of the array of pilot switches in sequence to provide a substantially common potential across the MEMS switch prior to closing the MEMS switch; and wherein the array of pilot switches comprises, at least one MEMS pilot switch and at least one semiconductor pilot switch.

14. The method of claim 13 further comprising opening or closing each of the array of pilot switches in sequence to provide a substantially common potential across the MEMS switch prior to opening the MEMS switch.

15. The method of claim 13 further comprising opening or closing each of the array of pilot switches in sequence to provide approximately zero current through the MEMS switch prior to opening the MEMS switch.

16. The method of claim 13 wherein the array of pilot switches comprises at least one shunt pilot switch coupled to a direct current (DC) reference.

17. The MEMS switch circuit of claim 1, wherein the pilot switch circuitry is adapted to be placed in the active pilot state by first closing the pilot MEMS switch and then placing the transistor switch in a conducting state prior to opening or closing the main MEMS switch.

18. The MEMS switch circuit of claim 17, wherein the pilot switch circuitry is adapted to be placed in an inactive pilot state by first placing the transistor switch in a non-conducting state and then opening the pilot MEMS switch after opening or closing the main MEMS switch.

19. The MEMS switch circuit of claim 9, wherein the pilot switch circuitry is adapted to be placed in the active pilot state by first selecting the first supplemental active pilot state followed by selecting the second supplemental active pilot state prior to opening or closing the main MEMS switch.

20. The method of claim 10 wherein activating the pilot switch circuitry further comprises first closing the second MEMS switch and then deactivating the transistor switch.

21. The method of claim 10 wherein deactivating the pilot switch circuitry further comprises first deactivating the transistor switch and then opening the second MEMS switch.

* * * * *

UNITED STATES PATENT AND TRADEMARK OFFICE

CERTIFICATE OF CORRECTION

PATENT NO. : 7,864,491 B1
APPLICATION NO. : 11/846237
DATED : January 4, 2011
INVENTOR(S) : Ruediger Bauder et al.

It is certified that error appears in the above-identified patent and that said Letters Patent is hereby corrected as shown below:

In column 12, at line 66, between “the” and “comprising,” please insert --transistor switch--.

Signed and Sealed this
Fifteenth Day of March, 2011

David J. Kappos

David J. Kappos
*Director of the United States Patent and Trademark Office*